United States Patent [19]

Sippel

[11] Patent Number: 4,532,738

[45] Date of Patent: Aug. 6, 1985

[54] METHOD OF REMOVING A COATING

[75] Inventor: David F. Sippel, Cincinnati, Ohio

[73] Assignee: General Electric Company, Cincinnati, Ohio

[21] Appl. No.: 562,609

[22] Filed: Dec. 19, 1983

[51] Int. Cl.[3] ..... B24C 1/00

[52] U.S. Cl. ..... 51/319; 250/226; 356/402; 73/7

[58] Field of Search ..... 51/319-321, 51/322, 311; 73/7; 356/402, 311; 250/226

[56] References Cited

U.S. PATENT DOCUMENTS 3,950,642 4/1976 Feld ..... 250/302

*Primary Examiner*—Frederick R. Schmidt
*Assistant Examiner*—Debra S. Meislin
*Attorney, Agent, or Firm*—Lee H. Sachs; Derek P. Lawrence

[57] ABSTRACT

An improved method for determining that coating has been removed from an article surface is provided for use in a method of removing a selected coating from an article surface having a composition different from the coating by impacting the coating with abrasive particles. The improved method includes selecting from the light spectrum a color which provides a color contrast between light emitted from the coating and light reflected from the article surface during coating removal in an impact intensity range using the abrasive particles. Provided is the selected color light environment in which the coated article surface is placed and then impacted with abrasive particles in the impact intensity range to create the color contrast and to remove coating from the article surface, the impact would be conducted until the color contrast disappears.

10 Claims, No Drawings

METHOD OF REMOVING A COATING

This invention relates to the removal of a coating from a substrate, and, more particularly, to the removal of a metallic coating from a metallic article surface of different composition by impacting with abrasive particles.

BACKGROUND OF THE INVENTION

During the repair of coated metal articles, primarily after they have been used in operation but sometimes after damage during manufacture, generally it is necessary first to remove the coating to expose the substrate for application of a repair technique. For example, coated gas turbine engine components, particularly high temperature operating parts such as turbine blades, vanes, nozzles, and combustors, frequently are protected from erosive, corrosive, and oxidation environments by coatings. Generally such coatings are metallic in nature, although ceramic or cermet-type coatings have been used.

During operation of such gas turbine engine components, environmental wear and attack as well as damage from foreign airborne objects can occur, particularly to those component portions upon which air or combustion product passing through the engine impinges. Prior to repair of such components, generally it is desirable to remove the coating with little or no damage to the substrate material. One commonly used method for coating removal, sometimes referred to as "grit blasting", involves impacting the coating with abrasive particles, frequently aluminum oxide. Commonly, such coating removal is conducted in an enclosure lighted by incandescent or fluorescent lights. Generally, the enclosure includes a viewing window and protected access ports for use by an operator in conducting the coating removal. In one form, the operator holds the article to be treated in rubber gloves disposed in the access ports while a grit blast nozzle projects abrasive against the coated surface to remove coating.

Under such conditions, it has been found that it is difficult to determine the point at which all coating material has been removed from a substrate which visually appears to be substantially the same as the coating. Excessive impacting of the article substrate by the abrasive particles after coating removal has resulted in damage or excessive substrate removal. Such a problem in distinguishing a coating from its substrate is particularly difficult in the case of metallic coatings on metallic substrates.

SUMMARY OF THE INVENTION

It is a principal object of the present invention to provide a method for visually determining when coating has been removed from a coated surface.

Another object is to provide an improved method for distinguishing between a coating and a coated surface during removal of the coating by abrasive particle impact.

These and other objects and advantages will be more clearly understood from the following detailed description and the examples all of which are intended to be typical of rather than in any way limiting on the scope of the invention as defined in the appended claims.

The present invention is useful in a method of removing a selected coating from an article surface having a composition different from that of the coating, the coating being capable of emitting light at an impact intensity range. The removal is conducted by impacting the coating with abrasive particles and concurrently inspecting the article surface to determine that the coating has been removed. In one form, the present invention includes selecting from the light spectrum a color which provides a color contrast between light emitted from the coating and light reflected from the article surface during coating removal in the impact intensity range. After such selection, a light environment of a selected color is provided and the coated article surface is placed in the light environment. Then the coating is impacted with the abrasive particles in the impact intensity range to create the color contrast and to remove coating from the article surface, the impacting being conducted until the color contrast disappears, thereby indicating removal of the coating.

The second color which produces a contrast with the first color of the emitted light may or may not be the same as the light reflected from the specimen article surface. It may be of a different color. As is well-known in the art of light and the reflection of light, the color of reflected light depends on the color of incident light and the color of the surface from which the incident light is reflected: the reflected color is a function of the wave length of light absorbed and the wave length of light reflected.

A preferred form of the method of the present invention is for removing a metallic coating from a metallic article surface when the coating is of aluminum or an alloy or compound of aluminum, including aluminide coatings. It has been found that selection and use of the color blue as the light environment results in a color contrast between a color in the range of yellow to orange emitted by the coating being removed and a background color of blue reflected from the article surface when impacting such a surface in the intensity range of at least about 70 pounds per square inch (psi). An intensity range of about 80–100 psi is preferred, using an abrasive of aluminum oxide.

DESCRIPTION OF THE PREFERRED EMBODIMENTS

Of particular interest during the evaluation of the present invention was the repair of a gas turbine engine cast turbine blade manufactured from an alloy commercially available as Rene' 80 nickel base superalloy and more particularly described in U.S. Pat. No. 3,615,376—Ross, patented Oct. 26, 1971. For environmental resistance, such component was protected with a diffusion aluminide coating, commercially available as CODEP coating, the composition and method for application of which is more particularly described in U.S. Pat. No. 3,540,878—Levine et al, patented Nov. 17, 1970. With such coating and substrate both being metallic in nature, it was found difficult for an operator of apparatus for abrasive coating removal, sometimes called "grit blasting", to distinguish between the coating and the substrate during removal. As a result, excessive substrate material sometimes was removed, with potential damage to the dimensional characteristics of the article being treated.

During the evaluation of the present invention, it was observed that in a darkened enclosure, that is, an unlighted environment, abrasive removal of the CODEP coating from the Rene' 80 alloy substrate surface resulted in the emission of light, generally in the yellow or off-white range. Subsequent evaluations during such abrasive coating removal were conducted using a variety of color filters for the light, encompassing the light spectrum from red through ultra-violet. For the particular combination of CODEP coating and Rene' 80 article surface as the substrate, it was found that the color blue provided a significant color contrast between the light emitted from the coating and the light reflected from the article surface during coating removal. In this example, the light emitted from the coating during removal was in the range of yellow to orange whereas the light reflected from the article surface when it was exposed after coating removal appeared blue. With this contrast provided, the operator could determine easily when the coating was removed by the disappearance of the color contrast.

In the particular example described above in connection with Rene' 80 alloy substrate and CODEP aluminide coating, the blue color was provided by projecting a fluorescent light through a sheet of blue acrylic plastic commercially available as Cyro Sapphire 204V Acrylite material. The abrasive used was an alumina of a 220 grit size impacted under a pressure in the range of about 80–90 psi. It will be understood by those skilled in the art, however, that a variety of colors, types and sizes of grit as well as impact conditions or intensity range can be used in the practice of the present invention, depending upon the particular coating and substrate being treated and the conditions under which light is emitted from the coating during abrasive impact removal.

Although the present invention has been described in connection with specific examples and embodiments, it will be understood by those skilled in the various arts involved the variations and modifications of which the present invention is capable without departing from the appended claims. For example, the present invention can be used in an automated system in which identification of the light emitted from the impacted coating can be made by instrumentation, and a color contrast most appropriately observable by instrumentation can be selected automatically. Thereafter, it is contemplated that automatic equipment, in a closed-loop type of operation, can remove the coating automatically by impacting the coated surface with abrasive particles until the color contrast disappears, as sensed by instrumentation.

What is claimed is:

1. A method of removing a selected coating from an article surface having a composition different from the coating, by impacting the coating with abrasive particles and concurrently inspecting the surface to determine that the coating has been removed, the coating being capable of emitting light in an impact intensity range, the steps of:

impacting the coating with abrasive particles in the impact intensity range and concurrently observing the light emitted as a first color;

selecting from the light spectrum a second color which provides a color contrast between the first color of light emitted from the coating and light reflected from the article surface during coating removal in the impact intensity range;

providing a light environment of the selected color;

placing the coated article surface in the light environment; and then, impacting the coating with the abrasive particles in the impact intensity range to create the color contrast and to remove coating from the article surface, the impacting being conducted until the color contrast disappears.

2. The method of claim 1 in which:

the coating is a metallic coating which includes aluminum;

the selected color of light is blue; and the color contrast is between the selected color blue at the article surface and a color in the range of about yellow to about orange at the coating.

3. The method of claim 2 in which:

the impacting is conducted in the intensity range of at least about 70 psi; and the abrasive particles include aluminum oxide.

4. The method of claim 2 in which:

the article surface is a nickel base alloy;

the coating is a diffusion coating selected from the group consisting of diffusion coatings of Al, of compounds of Al, and of alloys including Al diffused into the nickel base alloy surface.

5. The method of claim 4 in which the impact intensity range is about 80–100 psi.

6. In a method of removing a selected coating from an article surface having a composition different from the coating, by impacting the coating with abrasive particles and concurrently inspecting the surface to determine that the coating has been removed, the coating being capable of emitting light in an impact intensity range, the steps of:

providing a specimen of the selected coating on a specimen of the article surface;

impacting the coating specimen in an unlighted environment with abrasive particles in an impact intensity range sufficient to remove at least a part of the coating specimen and to emit an observable first color of light;

observing the first color of light emitted from the coating specimen during removal;

selecting a second color of light which in the presence of the emitted first color provides a color contrast between said first color of light emitted from the coating specimen and light reflected from the specimen article surface during coating removal in the impact intensity range; and thereafter, for coating removal from the article surface, providing a light environment of the second color;

placing the coated article surface in the light environment; and then impacting the coating with the abrasive particles in the impact intensity range to create the color contrast and to remove coating from the article surface, the impacting being conducted until the color contrast disappears.

7. The method of claim 6 in which:

the coating is a metallic coating which includes aluminum;

the second color of light is blue; and the color contrast between the second color blue at the article surface and a color in the range of about yellow to about orange at the coating.

8. The method of claim 7 in which the impacting is conducted in the intensity range of at least about 70 psi.

9. The method of claim 7 in which:

the article surface is a nickel base alloy;

the coating is a diffusion coating selected from the group consisting of diffusion coatings of Al, of compounds of Al, and of alloys including Al diffused into the nickel base alloy surface, and the abrasive particles include aluminum oxide.

10. The method of claim 9 in which the impact intensity range is about 80–100 psi.

* * * * *